US007560880B2

(12) United States Patent
Lai

(10) Patent No.: US 7,560,880 B2
(45) Date of Patent: Jul. 14, 2009

(54) CONTROL DEVICE FOR WORK LAMP

(76) Inventor: Li-Chun Lai, 21F-1, No. 33, Sec. 1, Minsheng Rd., Panciao City, Taipei County (TW)

( * ) Notice: Subject to any disclaimer, the term of this patent is extended or adjusted under 35 U.S.C. 154(b) by 468 days.

(21) Appl. No.: 11/548,722

(22) Filed: Oct. 12, 2006

(65) Prior Publication Data

US 2008/0088420 A1 Apr. 17, 2008

(51) Int. Cl.
*H05B 37/00* (2006.01)

(52) U.S. Cl. ..... 315/318; 315/312; 315/314; 315/360; 315/308; 345/77; 345/46; 345/690; 702/89

(58) Field of Classification Search ..... 315/200 A, 315/291, 294, 297, 307, 308, 312–314, 318, 315/320, 360, 362, DIG. 4; 345/46, 77, 82, 345/99, 204, 690, 691; 702/63, 64, 89; 307/10.8
See application file for complete search history.

(56) References Cited

U.S. PATENT DOCUMENTS

| | | | | |
|---|---|---|---|---|
| 5,924,784 | A * | 7/1999 | Chliwnyj et al. | 362/234 |
| 6,388,388 | B1 * | 5/2002 | Weindorf et al. | 315/169.3 |
| 6,429,598 | B1 * | 8/2002 | Haley | 315/141 |
| 7,391,297 | B2 * | 6/2008 | Cash et al. | 340/3.5 |
| 2008/0079568 | A1 * | 4/2008 | Primous et al. | 340/541 |

* cited by examiner

*Primary Examiner*—Haissa Philogene

(57) ABSTRACT

A control device for work lamp includes a microprocessor, which is able to receive signals sent from a power supply unit and a switch. The microprocessor is able to determine the number of times that the switch is pressed and then send out a command to the activation unit, which will in turn activate the light unit. All or a part (a quarter, half or three quarters) of the lights of the light unit may be turned on in their full brightness, half of their full brightness or a portion of the full brightness or in flashing light. Hence, the control device of the present invention allows a user to select from several brightness levels according to the actual needs so as to save electricity.

6 Claims, 8 Drawing Sheets

CONTROL DEVICE FOR WORK LAMP

BACKGROUND OF THE INVENTION

1. Field of the Invention

The invention generally relates to a control device used for a work lamp. More particularly, the invention relates to a control device which allows a user to select from several brightness levels according to the actual needs so as to save electricity.

2. Description of the Prior Art

In the prior art work lamp, a switch is used to control the supply of electricity. If such switch is switched on, the lamp will be turned on. If such switch is switched off, the lamp will be turned off. Hence, a user may turn the lamp on or turning it off and there is only one brightness level. Consequently, a user can not select from several brightness levels according to the actual needs and this causes a waste of electricity.

From the above, we can see that the prior art work lamp has many disadvantages and needs to be improved.

To eliminate the disadvantages of the prior art work lamp, the inventor has put in a lot of effort in the subject and has successfully come up with the control device for work lamp of the present invention.

SUMMARY OF THE INVENTION

The present invention is to provide a control device for work lamp that allows a user to select from several brightness levels according to the actual needs so as to save electricity.

The present invention is to provide a control device for work lamp that is easy to use and highly useful.

The control device for work lamp according to the present invention comprises a switch, a power supply unit, a voltage detection unit, a low voltage indicator light, a microprocessor, an RC timing circuit, a reactivation circuit, an activation unit and a light unit. The voltage detection unit is able to detect the voltage level of the power supply unit and will activate the low voltage indicator light if the voltage level of the power supply unit is lower than a predetermined value. The power supply unit is connected with the microprocessor so as to supply electricity to the latter. The switch is connected with the microprocessor. The RC timer circuit is able to measure the periods of time that the switch is in the OFF and ON conditions and then send the data to microprocessor so that the microprocessor will be able to accurately determine the number of times that the switch is pressed. The microprocessor will then send out a command to the activation unit, which will in turn activate the light unit. All or a part (a quarter, half or three quarters) of the lights of the light unit may be turned on in their full brightness, one half of their full brightness or a portion of the full brightness or in flashing light. Hence, the control device of the present invention allows a user to select from several brightness levels according to the actual needs so as to save electricity.

These features and advantages of the present invention will be fully understood and appreciated from the following detailed description of the accompanying Drawings.

DETAILED DESCRIPTION OF THE PREFERRED EMBODIMENT

Figure 1:
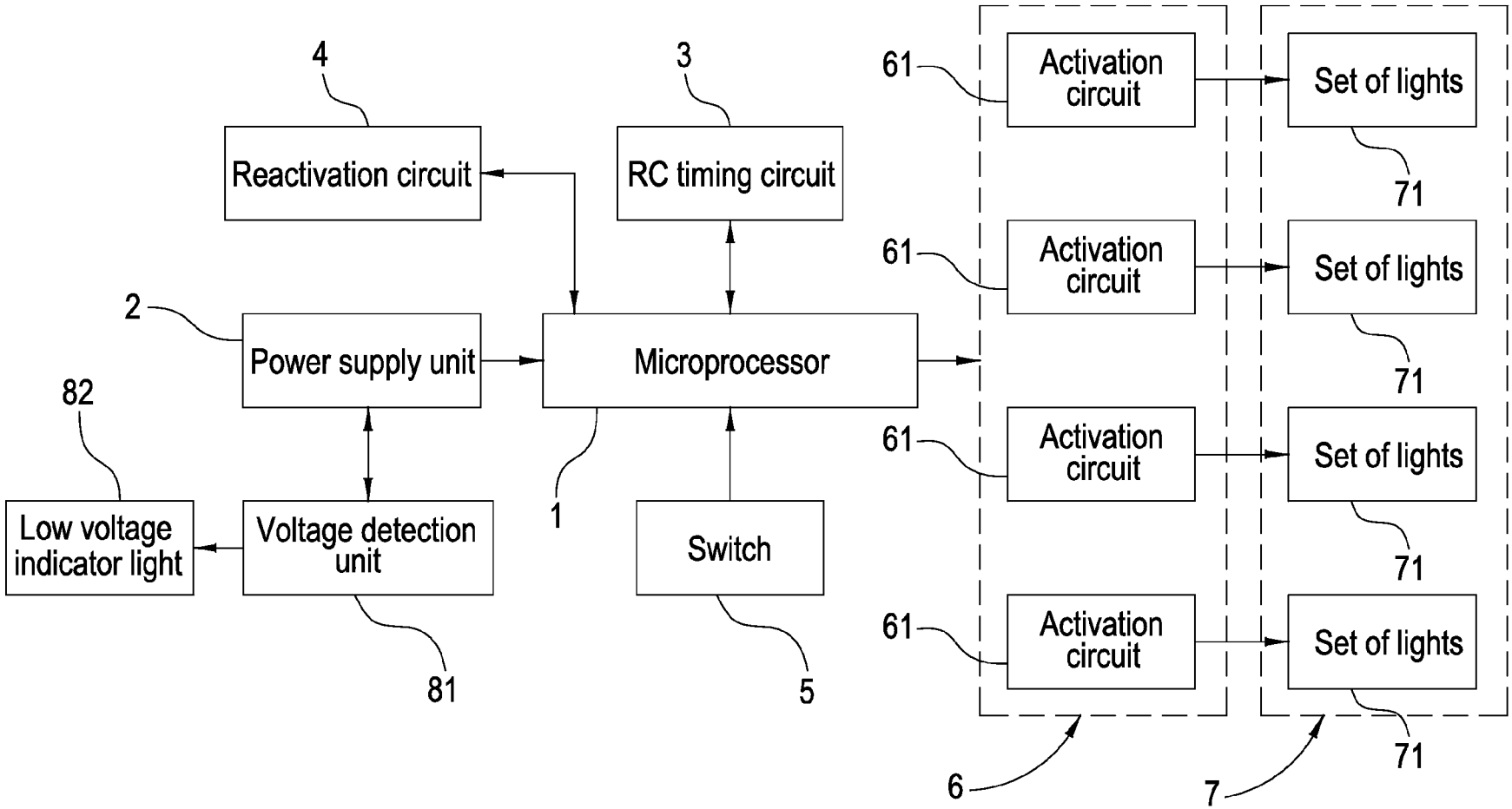
FIG. 1 is a block diagram schematically illustrating the control device for work lamp of the present invention.
Figure 2:
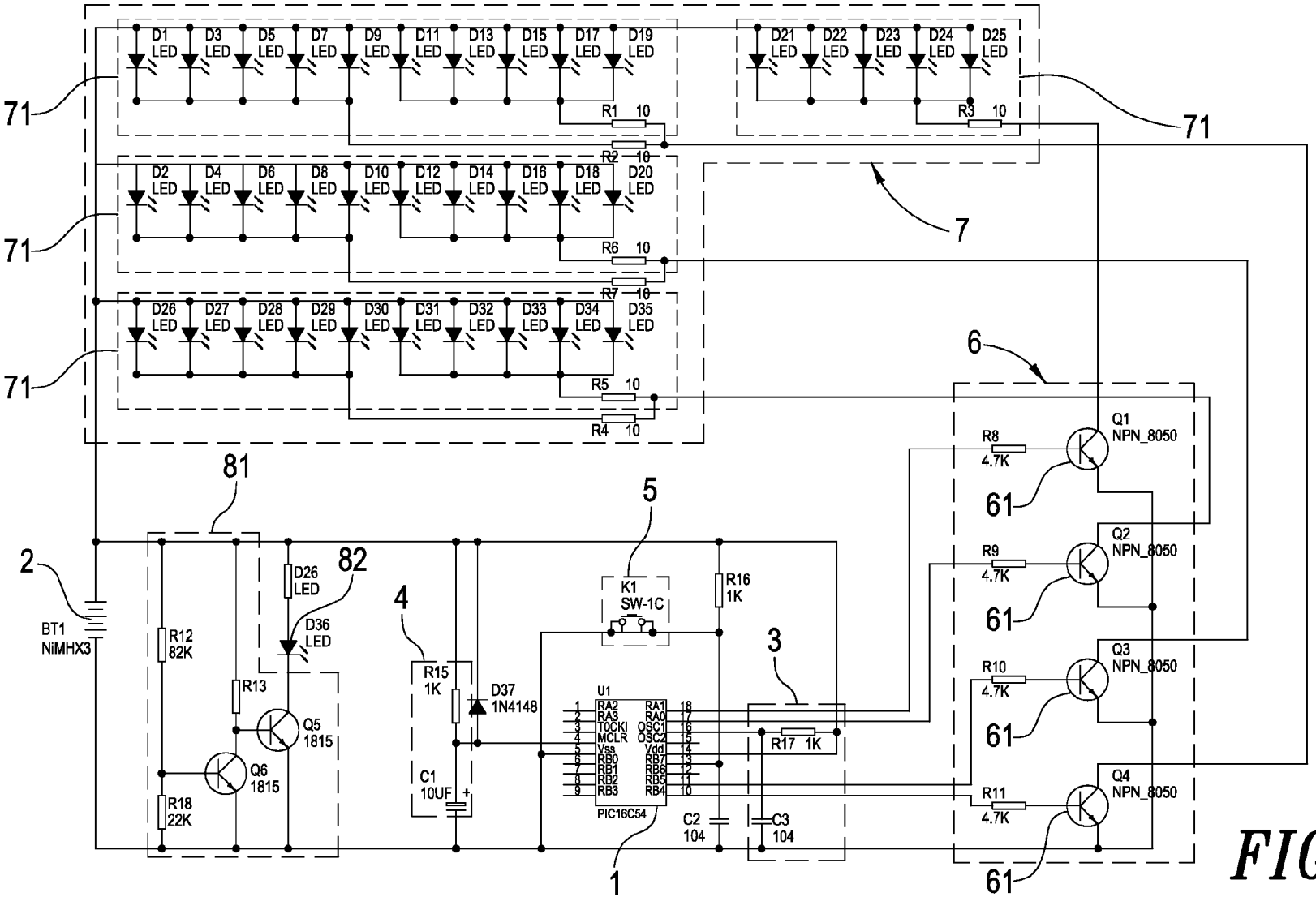
FIG. 2 is a diagram illustrating the circuits of the control device for work lamp of the present invention.

The control device for work lamp according to the present invention is shown in FIGS. 1 and 2 and comprises a microprocessor 1, a power supply unit 2, a voltage detection unit 81, a switch 5, an RC timing circuit 3, a reactivation circuit 4, an activation unit 6 and a light unit 7.

The microprocessor 1 may receive signals sent from the power supply unit 2, RC timer circuit 3, reactivation circuit 4 and switch 5. The microprocessor 1 can process these signals and then may send out a command to the activation unit 6 so as to turn on the light unit 7.

The power supply unit 2 is connected with the microprocessor 1 so as to supply electricity to the latter. The power supply unit 2 may be a battery, a dry cell, a lithium cell or other type of power supply device.

The voltage detection unit 81 is connected with the power supply unit 2 so as to detect the voltage level of the latter. If the voltage level of the power supply unit 2 is lower than a predetermined value, the voltage detection unit 81 will activate a low voltage indicator light 82.

The switch 5 is connected with the microprocessor 1, which can detect the number of times that the switch 5 has been pressed.

The RC timer circuit 3 is connected with the microprocessor 1. The RC timer circuit 3 may receive the signals sent from the switch 5. When the switch 5 is in the OFF condition for a predetermined period of time (i.e., when the switch 5 is not pressed for a predetermined period of time), the RC timer circuit 3 will send a signal to the microprocessor 1 and then the microprocessor 1 will stop counting. When the switch 5 is turned to ON for a predetermined period of time (i.e., when the switch 5 is pressed for a predetermined period of time), the RC timer circuit 3 will send a signal to the microprocessor 1 and then the microprocessor 1 will stop counting.

The reactivation circuit 4 is connected with the microprocessor 1 and the power supply unit 2. When an abnormal condition occurs in the microprocessor 1 or the power supply unit 2 is disconnected, the reactivation circuit 4 will reactivate the microprocessor 1.

The activation unit 6 comprises a plurality of activation circuits 61. Each activation circuit 61 may activate a set of lights 71. The activation unit 6 is connected with the microprocessor 1 so that the activation unit 6 may activate the light unit 7 according to the command of the microprocessor 1.

The light unit 7 comprises several sets of lights 71. Each set of lights includes a plurality of lights. Each set of lights 71 is connected with a corresponding activation circuit 61. Hence, all or a part of the lights of the light unit may be turned on in their full brightness, one half of their full brightness, a portion of the full brightness or in flashing light.

Figure 3A:
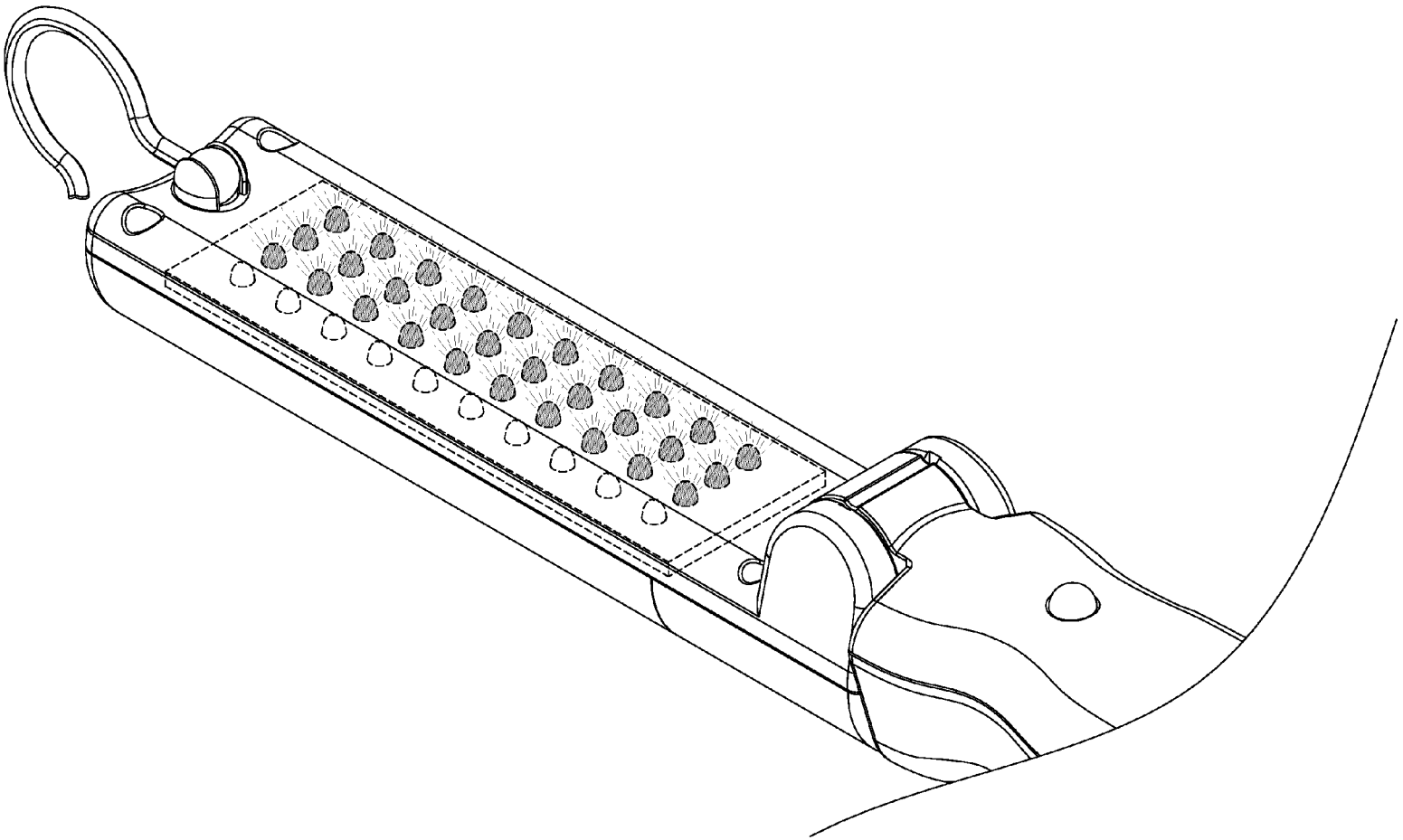
FIGS. 3A to 3F are perspective views showing several patterns which the light unit may have.

FIGS. 3A to 3F illustrate the seven patterns that the light unit 7 may have. These seven patterns are:

(1) When the switch 5 is pressed for once, "one time of pressing" will be registered in the microprocessor 1 and the RC timer circuit 3 will start timing how long the switch 5 is in the OFF condition. If the period that the switch 5 is in the OFF condition exceeds a predetermined period of time, the microprocessor 1 will reach such conclusion: a user intends to press the switch 5 for one time. Now, the microprocessor 1 will send out a command to the activation unit 6 to activate the first three sets of the lights (the fourth set will not be lit) as illustrated in FIG. 3A.

Figure 3B:
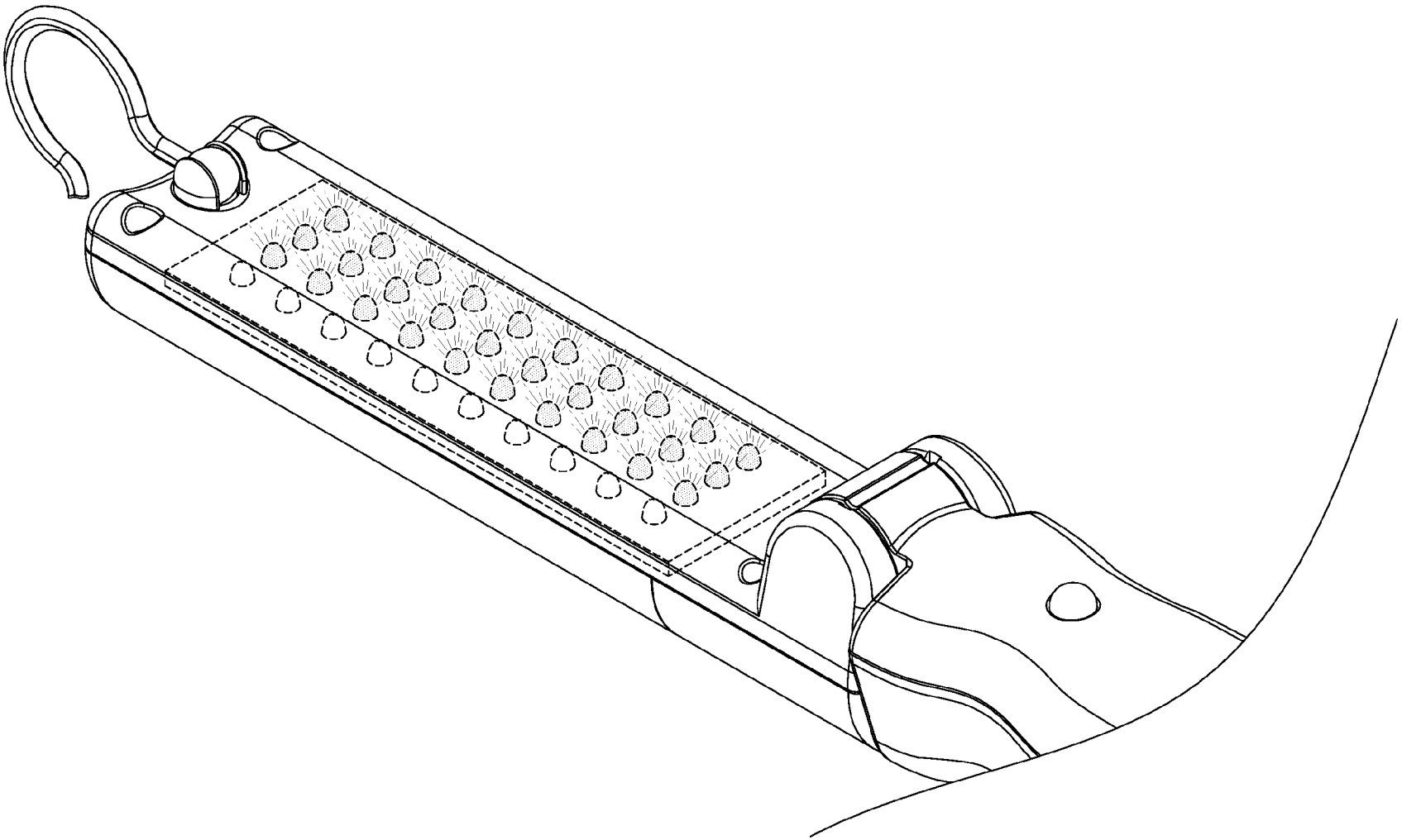

(2) When the switch 5 is pressed for twice, "two times of pressing" will be registered in the microprocessor 1. Now, the microprocessor 1 will send out a command to the activation unit 6 to activate the first three sets of the lights (the fourth set will not be lit) to send out light in half of their full brightness as illustrated in FIG. 3B.

Figure 3C:
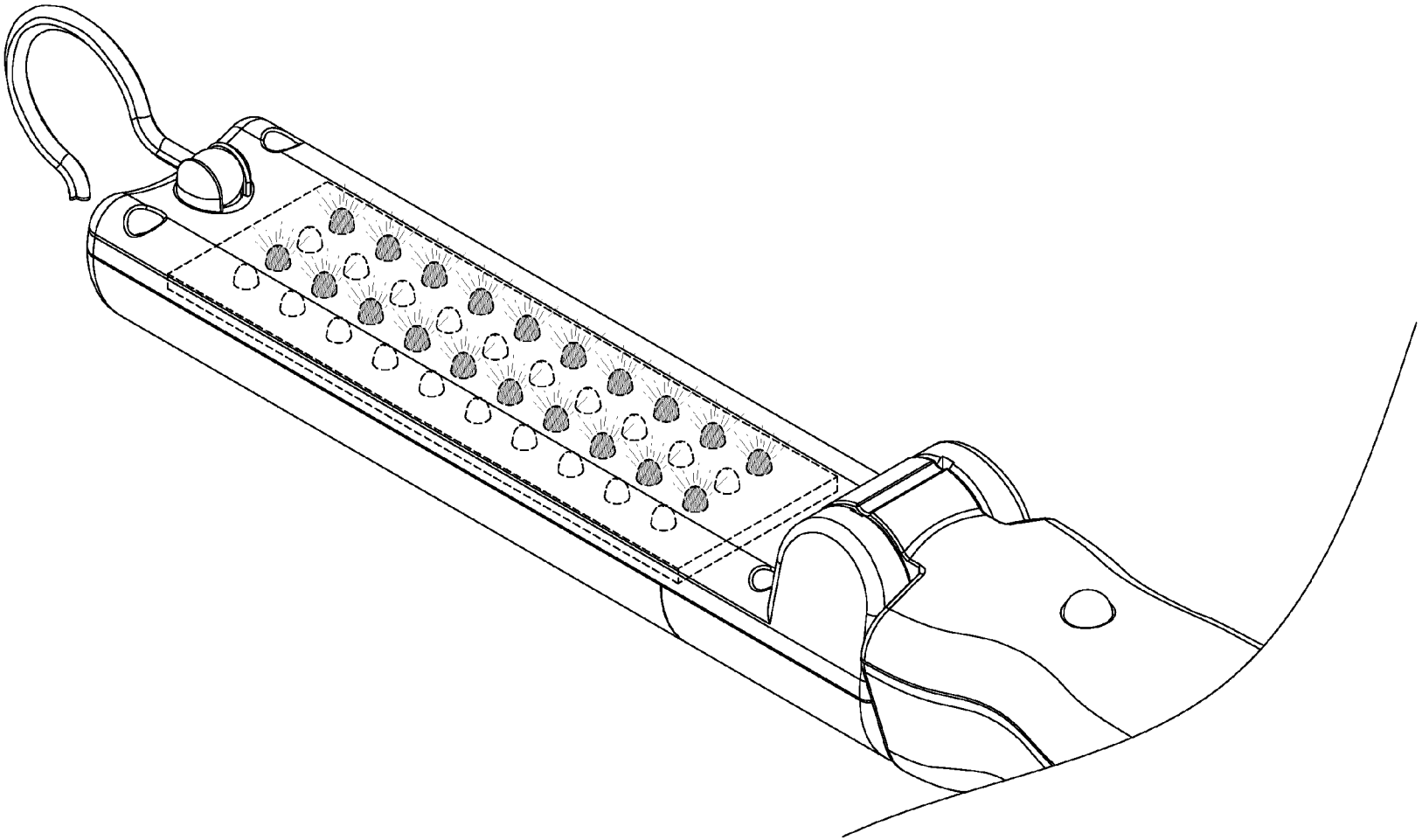

(3) When the switch 5 is pressed for three times, "three times of pressing" will be registered in the microprocessor 1. Now, the microprocessor 1 will send out a command to the activation unit 6 to activate the first and third sets of the lights (the second and fourth sets will not be lit) as illustrated in FIG. 3C.

Figure 3D:
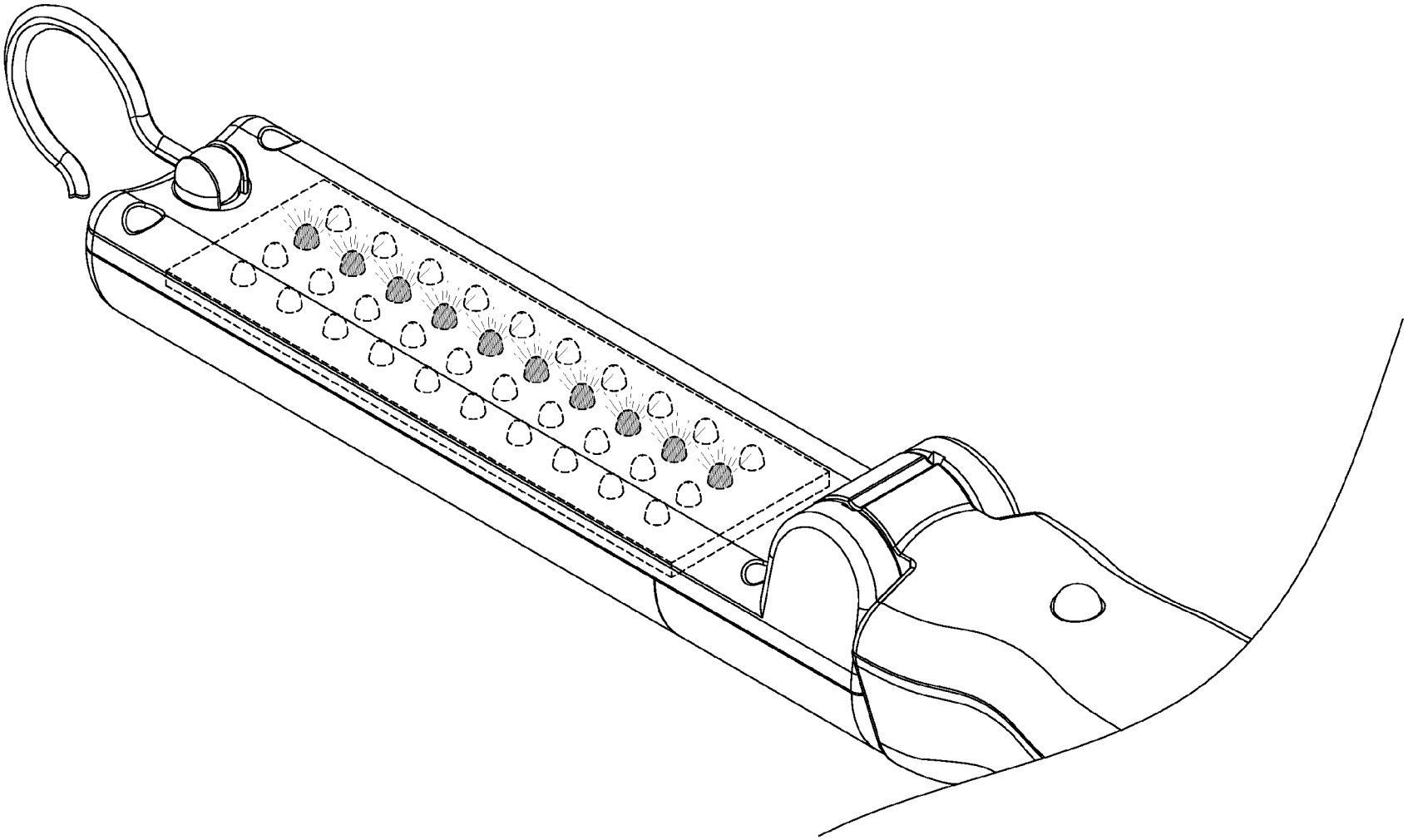

(4) When the switch 5 is pressed for four times, "four times of pressing" will be registered in the microprocessor 1. Now, the microprocessor 1 will send out a command to the activation unit 6 to activate the second set of the lights (other sets will not be lit) as illustrated in FIG. 3D.

Figure 3E:
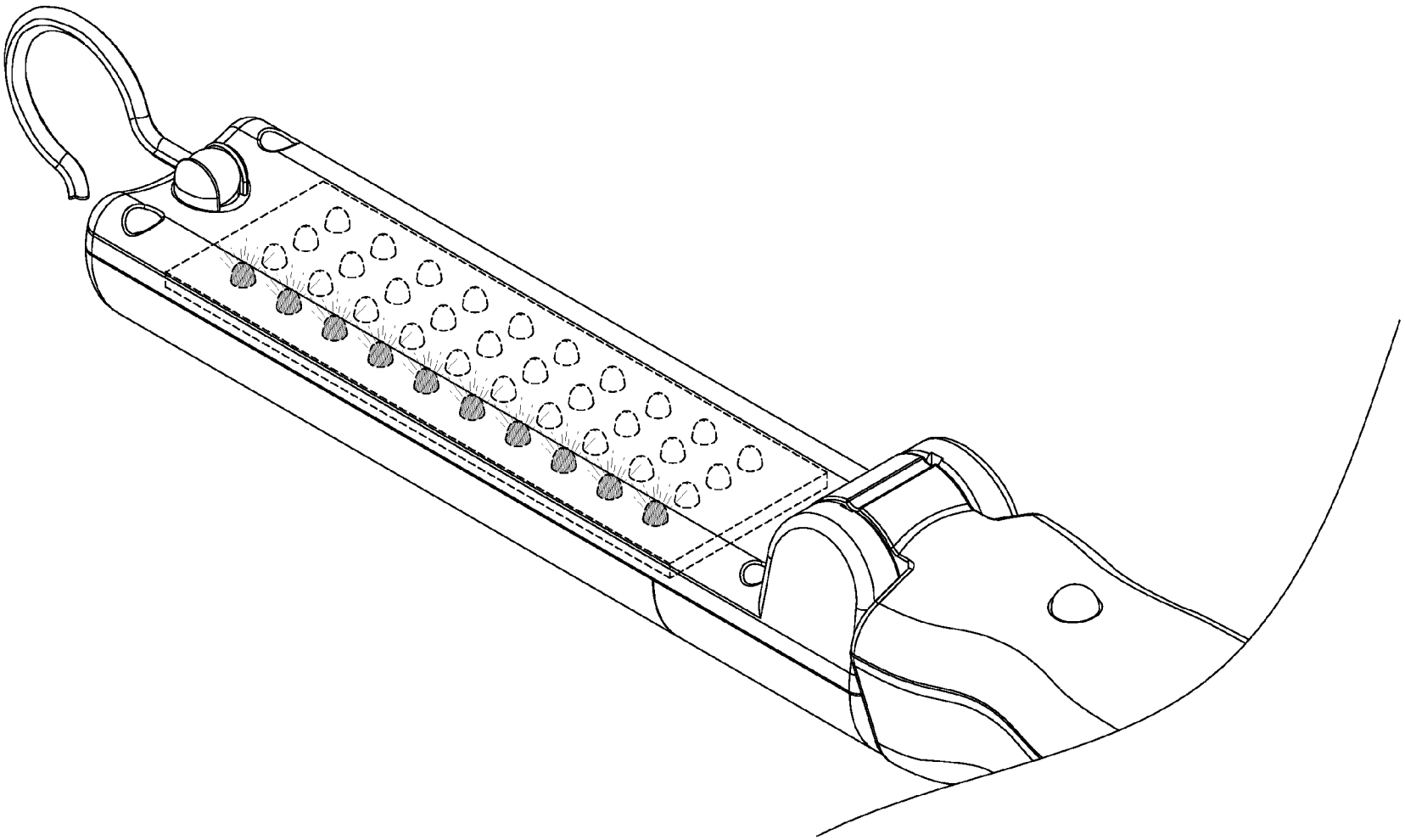

(5) When the switch 5 is pressed for five times, "five times of pressing" will be registered in the microprocessor 1. Now, the microprocessor 1 will send out a command to the activation unit 6 to activate the fourth set of the lights (other sets will not be lit) as illustrated in FIG. 3E.

(6) When the switch 5 is pressed for six times, "six times of pressing" will be registered in the microprocessor 1. Now, the microprocessor 1 will send out a command to the activation unit 6 to make the first three sets of the lights send out flashing light (the fourth set will not be lit).

Figure 3F:
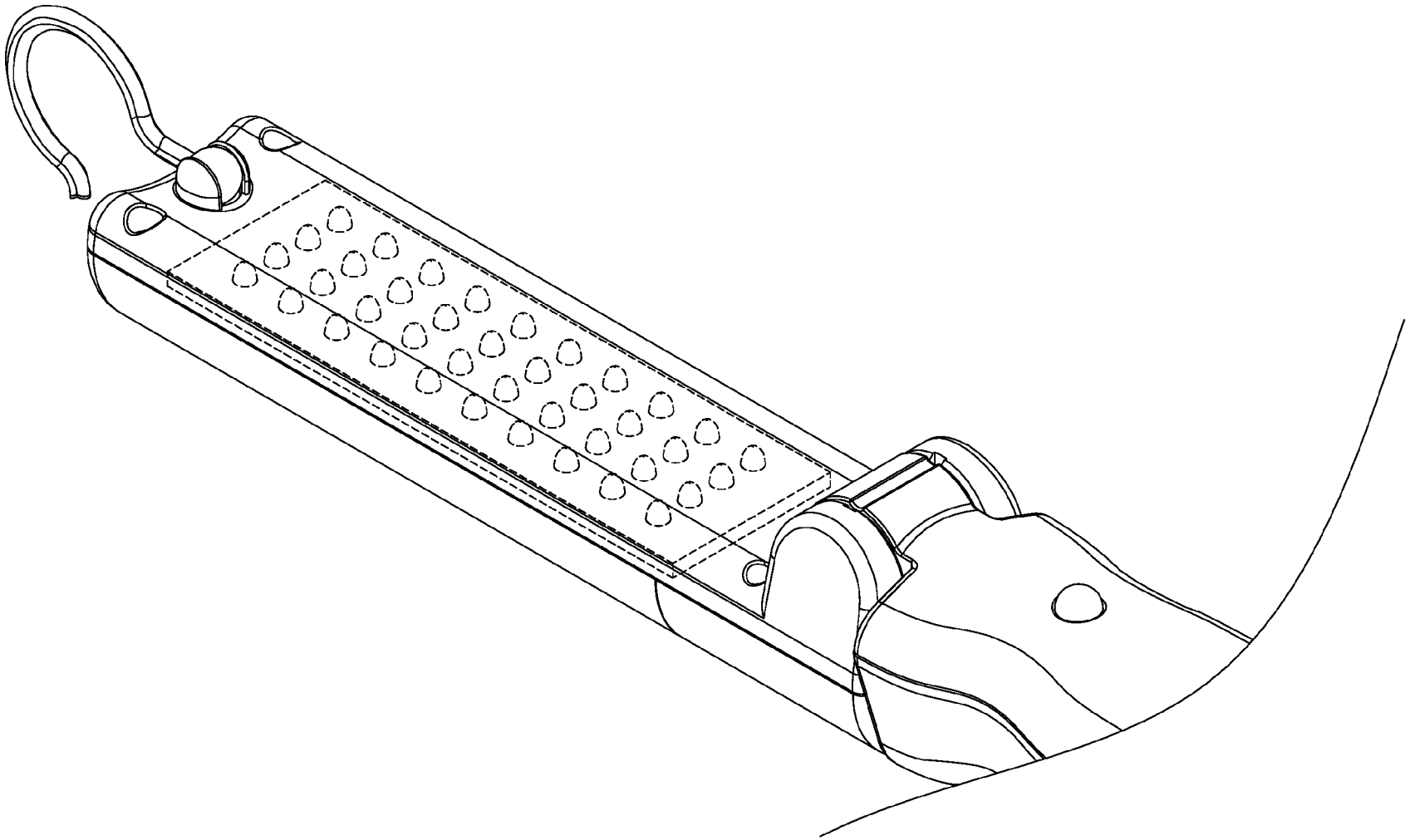

(7) If the switch 5 is kept in the ON condition (i.e., when the switch 5 is pressed continuously), the microprocessor 1 will send out a command to the RC timer circuit 3 so that the RC timer circuit 3 will start to measure the period of time that the switch 5 is kept in the ON condition. If such period of time exceeds a predetermined period of time, the microprocessor 1 will reach such conclusion: the switch 5 is pressed continuously for a long period of time. Now, the microprocessor 1 will send out a command to turn off all sets of lights as illustrated in FIG. 3F.

The aforesaid patterns should be regarded as an embodiment of the present invention and are to be regarded as illustrative rather than restrictive.

In comparison to the prior art, the control device of the present invention has the following two advantages:

1. The control device of the present invention allows a user to select from several brightness levels according to the actual needs so as to save electricity.
2. The control device of the present invention is easy to use and highly useful.

Although a preferred embodiment of the present invention has been described in detail hereinabove, it should be understood that the preferred embodiment is to be regarded in an illustrative manner rather than a restrictive manner, and all variations and modifications of the basic inventive concepts herein taught still fall within the scope of the present invention.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A control device for work lamp, comprising:

a microprocessor, able to receive signals sent from a power supply unit, an RC timer circuit, a reactivation circuit and a switch and able to process and analyze these signals;

the power supply unit, connected with the microprocessor so as to supply electricity to the microprocessor;

the switch, connected with the microprocessor, which may detect the number of times that the switch is pressed;

the RC timer circuit, connected with the microprocessor and able to receive the signals sent from the microprocessor so as to measure the periods of time that the switch is in the OFF and ON conditions and then send data to microprocessor so that the microprocessor will be able to accurately determine the number of times that the switch is pressed;

an activation unit, comprising a plurality of activation circuits and connected with the microprocessor so that the activation unit activates a light unit according to the command of the microprocessor, wherein each activation circuit activates a set of lights; and the light unit, comprising several sets of lights and connected with the activation unit so that the light unit is activated by activation unit, wherein all or a part of the lights of the light unit are turned on in their full brightness, one half of their full brightness, a portion of the full brightness or in flashing light.

2. The control device for work lamp as in claim 1, wherein the power supply unit is a battery, a dry cell or a lithium cell.

3. The control device for work lamp as in claim 1, wherein the control device further comprises a voltage detection unit, which is able to detect the voltage level of the power supply unit and will activate a low voltage indicator light if the voltage level of the power supply unit is lower than a predetermined value.

4. The control device for work lamp as in claim 1, wherein the control device further comprises a reactivation circuit, which is connected with the microprocessor and the power supply unit, and wherein the reactivation circuit will reactivate the microprocessor when an abnormal condition occurs in the microprocessor or the power supply unit is disconnected.

5. The control device for work lamp as in claim 1, wherein each set of lights is connected with a corresponding activation circuit.

6. The control device for work lamp as in claim 1, wherein the light unit comprises several sets of lights and each set of lights includes a plurality of lights.

* * * * *